US010308397B2

(12) United States Patent
Smith et al.

(10) Patent No.: US 10,308,397 B2
(45) Date of Patent: Jun. 4, 2019

(54) TRAY FOR REPLACEABLE PORTIONS OF AN ELECTRONIC SMOKING DEVICE

(71) Applicant: FONTEM HOLDINGS 1 B.V., Amsterdam (NL)

(72) Inventors: Simon James Smith, Cambridge (GB); Charles Kevin Dillon, Cambridge (GB); Daniel Luke Coveney, Cambridge (GB)

(73) Assignee: FONTEM HOLDINGS 1 B.V., Amsterdam (NL)

( * ) Notice: Subject to any disclaimer, the term of this patent is extended or adjusted under 35 U.S.C. 154(b) by 466 days.

(21) Appl. No.: 15/216,535

(22) Filed: Jul. 21, 2016

(65) Prior Publication Data

US 2017/0021969 A1 Jan. 26, 2017

(30) Foreign Application Priority Data

Jul. 24, 2015 (EP) ..... 15178291

(51) Int. Cl.

| | |
|---|---|
| ***B65D 25/10*** | (2006.01) |
| ***A24F 15/00*** | (2006.01) |
| ***A24F 47/00*** | (2006.01) |
| ***B65D 85/00*** | (2006.01) |

(52) U.S. Cl.

CPC ..... *B65D 25/108* (2013.01); *A24F 15/00* (2013.01); *A24F 47/008* (2013.01); *B65D 85/70* (2013.01)

(58) Field of Classification Search

CPC ..... B65D 25/108; B65D 85/70; A24F 15/00; A24F 47/008

USPC ..... 206/256; 131/347

See application file for complete search history.

(56) References Cited

U.S. PATENT DOCUMENTS

2012/0227753 A1* 9/2012 Newton ..... A24F 47/008 131/347

2015/0201676 A1 7/2015 Shin

FOREIGN PATENT DOCUMENTS

| | | | |
|---|---|---|---|
| CN | 204120219 | U | 1/2015 |
| DE | 202014001717 | U1 | 5/2015 |
| WO | 2015065943 | A1 | 5/2015 |

OTHER PUBLICATIONS

European Patent Office, extended European Search Report for EP15178291.9, dated Jan. 21, 2016.

* cited by examiner

*Primary Examiner* — King M Chu

(74) *Attorney, Agent, or Firm* — Perkins Coie LLP; Kenneth H. Ohriner

(57) ABSTRACT

A tray (50) configured for receiving replaceable portions (26, 26') of an electronic smoking device (10) is disclosed. The tray (50) has cavities (52) each configured for receiving a replaceable portion (26, 26') for being releasably clamped therein. The replaceable portion (26, 26') is releasably clamped by a movement (R) with respect to the tray (50).

19 Claims, 5 Drawing Sheets

TRAY FOR REPLACEABLE PORTIONS OF AN ELECTRONIC SMOKING DEVICE

CROSS REFERENCE TO RELATED APPLICATIONS

This application claims the benefit of European Patent Application No. 15178291.9, filed Jul. 24, 2015, which is incorporated herein by reference.

FIELD OF INVENTION

The present invention relates generally to electronic smoking devices and in particular electronic cigarettes. More specifically, the present invention relates to trays for replaceable portions of electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

In some electronic smoking devices, the atomizer and/or other portions of the electronic smoking device can be removed and replaced.

SUMMARY OF THE INVENTION

In accordance with one aspect of the present invention, a tray is provided. The tray is configured for receiving replaceable portions of an electronic smoking device such as an atomizer. The tray comprises cavities each configured for receiving a replaceable portion for being releasably clamped therein. The replaceable portion is releasably clamped by a movement with respect to the tray.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
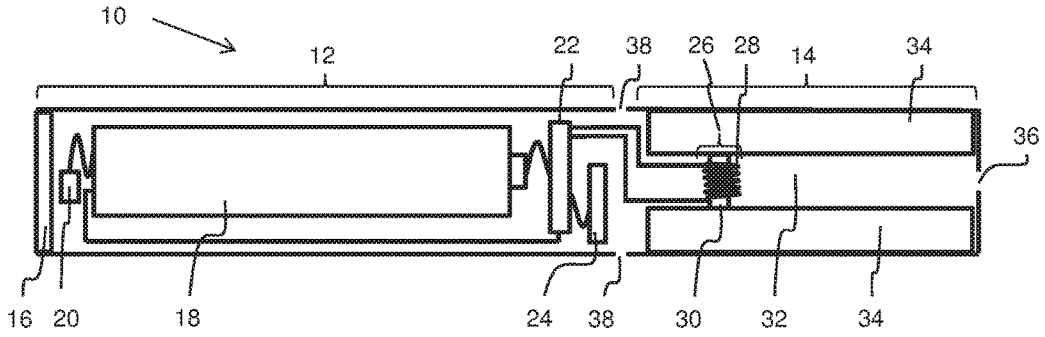
FIG. 1 is a schematic illustration of an electronic smoking device.

Throughout the following, an electronic smoking device will be exemplarily described with reference to an e-cigarette. As is shown in FIG. 1, an e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a battery portion 12 and an atomizer/liquid reservoir portion 14. Together the battery portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of metal, e.g. steel or aluminum, or of hardwearing plastic and act together with the end cap 16 to provide a housing to contain the components of the e-cigarette 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, an LED 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol, more liquid is drawn into the wick 30 from the liquid reservoir 34 by capillary action and thus is available to be converted into an aerosol through subsequent activation of the heating coil 28.

The battery 18 is rechargeable and the liquid reservoir 34 is refillable or replaceable. In the cases where the liquid reservoir 34 is a toroidal cavity, this may be achieved by refilling the liquid reservoir 34 via a refill port.

In other embodiments the atomizer/liquid reservoir portion 14 of the e-cigarette 10 is detachable from the battery portion 12 and another atomizer/liquid reservoir portion 14 can be fitted thereby replenishing the supply of liquid as well as replacing the heating coil 28 and the wick 30. A replaceable portion comprising the atomizer 26 and the liquid reservoir 34 is also called a cartomizer. Said other liquid reservoir 34 may be in the form of a cartridge having a central passage 32 through which a user inhales aerosol. In other embodiments, aerosol may flow around the exterior of the cartridge 32 to an air inhalation port 36.

In some cases, replacing the liquid reservoir 34 may involve replacement of the heating coil 28 and the wick 30 along with the replacement of the liquid reservoir 34. A replaceable portion comprising the atomizer 26 and the liquid reservoir 34 is called a cartomizer.

In other embodiments, the atomizer/liquid reservoir portion 14 of the e-cigarette 10 is detachable from the battery portion 12 and the atomizer 26 is detachable from the liquid reservoir 34. A liquid reservoir portion 14 may be replaced or changed while further using the same atomizer 26 or the heating coil 28 and the wick 30 may be replaced without replacing the liquid reservoir 34. For example, flavor and/or strength of liquid may be thereby varied without changing the atomizer 26 and the atomizer 26 may be thereby replaced without discarding liquid remaining in the liquid reservoir 34.

In some embodiments, the atomizer is attached to the liquid reservoir 34 of the e-cigarette 10 for forming the atomizer/liquid reservoir portion 14 which is subsequently attached to the battery portion 12. In some embodiments, the atomizer is attached to the battery portion 12 to which subsequently the liquid reservoir 34 is attached for forming the e-cigarette 10.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Figure 2:
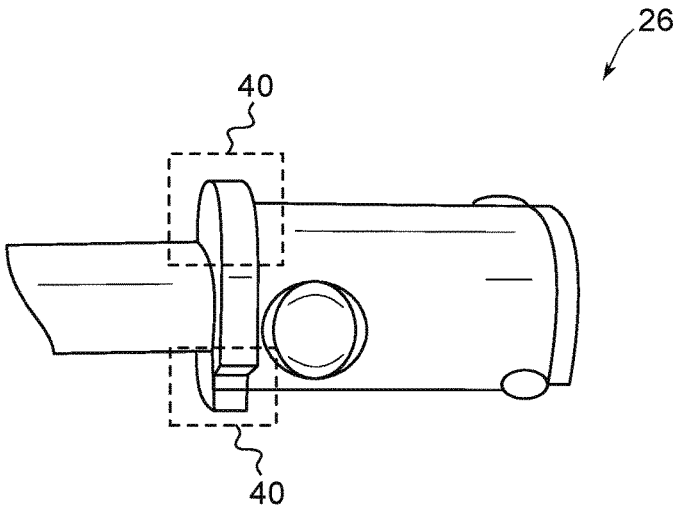
FIG. 2 is a schematic illustration of an atomizer exemplifying a replaceable portion of an electronic smoking device.

FIG. 2 is a schematic illustration of the atomizer 26. The atomizer 26 is an example for a replaceable portion of an electronic smoking device. Extending radially to the hollow passage (not shown) and circumferential thereto, there are dents of a dented part 40 of the surface of the atomizer 26.

Figure 3:
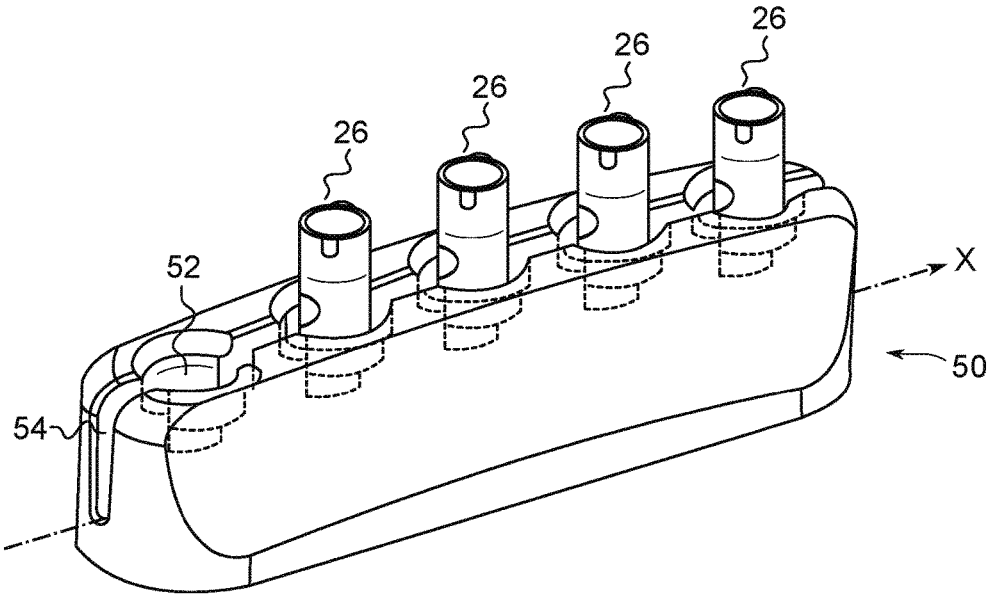
FIG. 3 is a schematic illustration of a tray according to an embodiment of the invention.

FIG. 3 is a schematic illustration of the tray according to an embodiment of the invention. Exemplarily, the tray 50 comprises five cavities 52 arranged along and connected by a furrow 54 extending in a first direction X. The tray may comprise fewer or more and/or the furrow may be absent.

The cavities 52 are arranged equidistant to each other but this is optional. The uniform configuration of the cavities 52 is also optional.

In the depiction of FIG. 3, one cavity, the one on the left, is empty and atomizers 26, exemplifying replaceable portions of an electronic smoking device, are, respectively can be, releasably (detachably) clamped (attached, fixed) into the other cavities 52. Hence the atomizer 26 can also be considered to be releasably locked into the cavities. Exemplarily, the atomizers are unused.

This embodiment of the present invention has been illustrated using an atomizer as a replaceable portion, but the present invention is not limited thereto. It is also possible to utilize other components of an electronic smoking device as the replaceable portion, e.g. liquid reservoirs or cartomizers.

Figure 4:
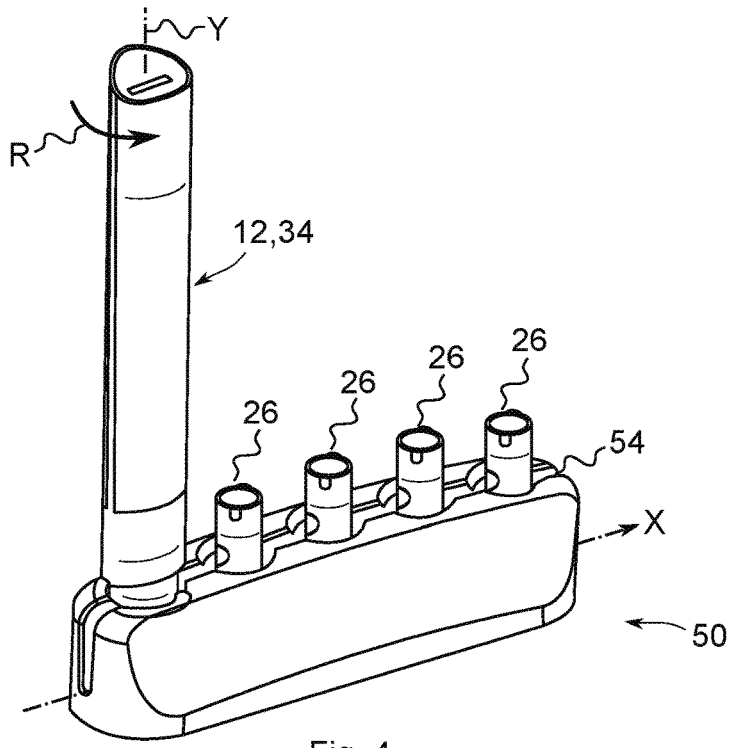
FIG. 4 is a schematic illustration of releasably clamping an atomizer into and/or releasing the atomizer from the atomizer/liquid portion using the tray of FIG. 3.

FIG. 4 is a schematic illustration of releasably clamping (locking) an, e.g. used, atomizer 26' in the empty cavity of the tray of FIG. 3 while being attached to a further portion of an electronic cigarette, e.g. a liquid reservoir 34 and/or a battery portion 12, and/or of releasing the clamped atomizer 26' from the further portion using the tray of FIG. 3.

Both are exemplarily achieved by a rotation R around an axis Y. In the example depicted, axis Y is perpendicular to direction X but this is optional. A first rotational movement releasably clamps the atomizer 26' in the tray and a further rotational movement being a continuous prolongation of the first rotational movement releases the atomizer 26' from the liquid reservoir 34 and/or the battery portion 12.

Releasable clamping can be achieved, for example, by interaction of an inner surface, or a part thereof, of the cavities with the dents of the atomizer. Other forms of releasable clamping comprise a friction push fit, a snap fit, or a bayonet attachment, magnetic fit, or screw threads.

In some embodiments, a force required for releasably clamping the atomizer in the tray does not exceed a further force required for releasing the atomizer from the further portion. Hence, a continuous movement of the further portion relative to the tray caused by the further force first releasably clamps the atomizer in the tray and then detaches the atomizer from the further portion. Thereby, the atomizer can be detached easily from the further portion without the need to touch the atomizer.

Figure 5:
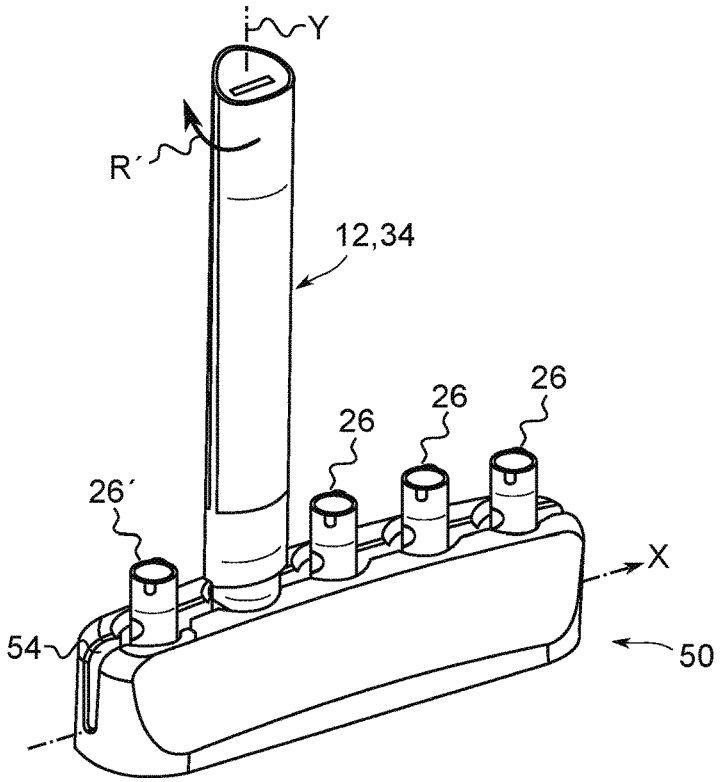
FIG. 5 is a schematic illustration of attaching an atomizer/liquid portion to an atomizer being clamped in the tray of FIG. 3 as well as releasing a clamped atomizer from the tray of FIG. 3.

FIG. 5 is a schematic illustration of attaching a liquid reservoir 34 and/or a battery portion 12 to an, e.g. unused, atomizer 26 clamped (locked) in one of the other cavities 52 of the tray 50 of FIG. 3 and/or of releasing (unlocking) the clamped atomizer 26 from the tray of FIG. 3.

Said attaching/releasing is exemplarily achieved by a counter-rotation R' (opposite to rotation R) around axis Y. A first rotational counter-movement attaches the liquid reservoir 34 and/or the battery portion 12 to the atomizer 26 clamped in the tray 50 a further rotational counter movement being a continuous prolongation of the first rotational counter movement releases the atomizer 26 from the tray 50.

In some embodiments a counter-force required for releasing the atomizer from the tray equals or exceeds a further counter-force required for attaching the atomizer to the further portion. Hence, a continuous counter-movement of the further portion relative to the tray caused by the counter-force first attaches it to the atomizer and then releases the atomizer from the clamping. Thereby, the atomizer can be attached easily to the further portion without the need to touch the atomizer.

Figure 6:
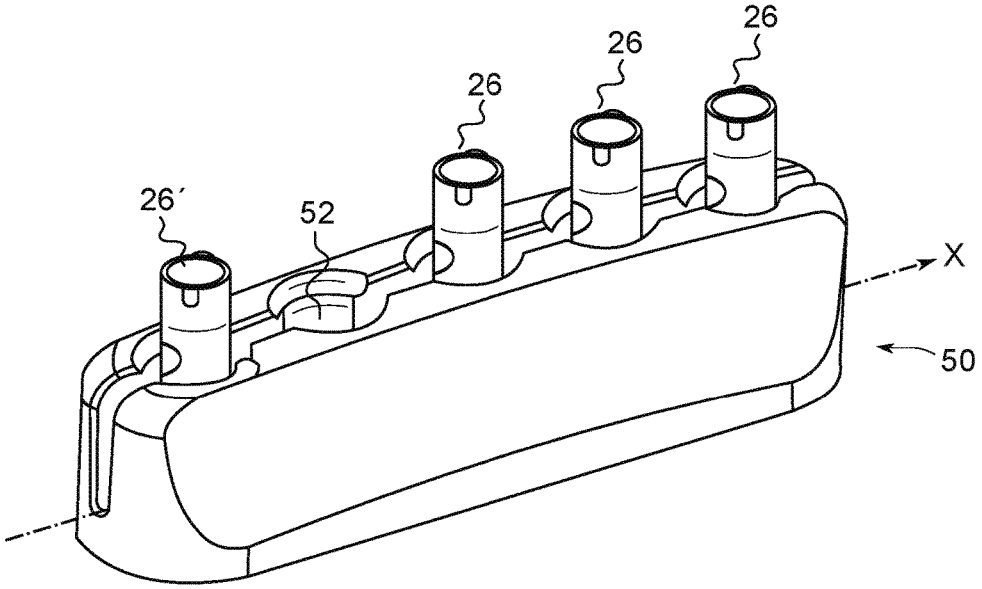
FIG. 6 is another schematic illustration of the tray of FIG. 3.

FIG. 6 is another schematic illustration of the tray of FIG. 3 after insertion of a used atomizer 26' into the empty cavity of FIG. 3 and releasing an unused atomizer 26 from one of the other cavities of FIG. 3. Hence, FIGS. 3 to 6 depict exemplarily different steps of a method according to an embodiment of the invention for replacing an atomizer.

Figure 7:
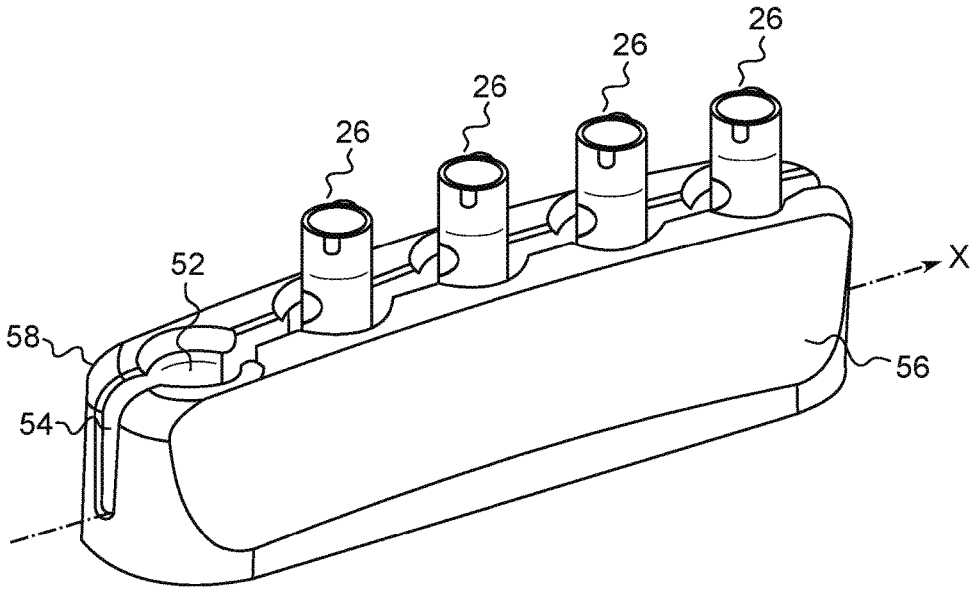
FIG. 7 is a schematic illustration of a tray according to another embodiment of the invention.

FIG. 7 is a schematic illustration of a tray according to another embodiment of the invention. Exemplarily, the tray 50 comprises five cavities 52 arranged along and connected by a furrow 54 extending in a first direction X. The tray may comprise fewer or more cavities. Due to the furrow 54, width of the cavities 52 can be increased by applying pressure perpendicular to the first direction X on opposite surfaces 56, 58 of the tray 50, thereby opening the cavities 52 like a clamp.

Figure 8:
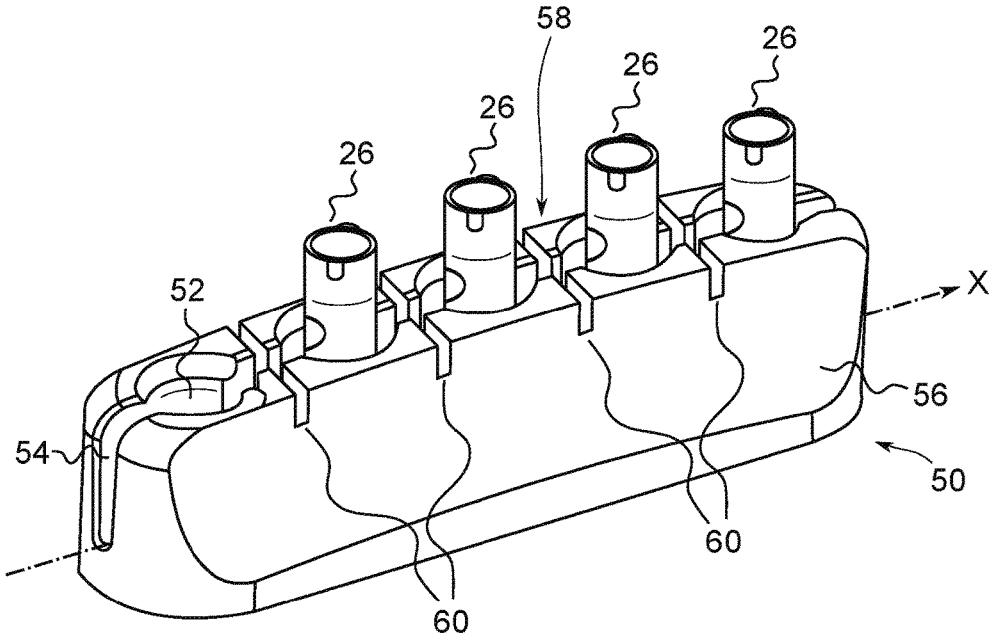
FIG. 8 is a schematic illustration of a tray according to still another embodiment of the invention.

FIG. 8 is a schematic illustration of a tray according to yet another embodiment of the invention. In this embodiment, the tray is configured such that different pairs of opposing areas exist on the opposite surfaces 56, 58 with a pair of opposing areas for each cavity. The tray then can be configured such that applying pressure perpendicular to the first direction X on one of the pair of opposing areas increases the width of the respective cavity only. This may be achieved, for example, by further furrows 60 extending perpendicular to the first direction X and to axis Y and crossing the furrow 54 between the cavities 52.

In FIGS. 3 to 8 only the atomizers 26 are depicted but in embodiments of the invention the atomizers 26 may be the only depicted parts of cartomizers constituting replaceable portions further comprising the liquid reservoirs 34. In other embodiments of the invention, the replaceable portions may comprise only the liquid reservoir(s) but no atomizers. In this sense, the above described embodiments of the present invention have been illustrated using an atomizer as a replaceable portion, but the present invention is not limited thereto. It is also possible to utilize other components of an electronic smoking device as the replaceable portion, e.g. liquid reservoirs or cartomizers.

Hence, embodiments of the invention concern a tray for cartomizers for releasable attachment to a further portion of an electronic smoking device, the tray comprising cavities each configured for receiving a cartomizer for being releasably clamped therein by a movement with respect to the tray. Said movement may be a movement of a further portion of the electronic smoking device releasably attached to the cartomizer. Optional embodiments of the invention described above with respect to an atomizer and equally applicable to a cartomizer may be comprised optionally in the tray for cartomizers.

As well, other embodiments of the invention concern a tray for atomizer of an electronic smoking device for releasable attachment to a further portion of an electronic smoking device, the tray comprising cavities each configured for receiving an atomizer for being releasably clamped therein by a movement with respect to the tray. Said movement may be a movement of a further portion of the electronic smoking device releasable attached to the atomizer.

Other embodiments of the invention concern a tray for replaceable portions (e.g. liquid reservoirs, atomizers and/or cartomizers) for releasable attachment to a further portion of an electronic smoking device, the tray comprising cavities each configured for receiving a replaceable portion (e.g. liquid reservoir, atomizer or cartomizer) for being releasably clamped therein by a movement, with respect to the tray, of a further portion of the electronic smoking device releasably attached to the replaceable portion (e.g. liquid reservoir, atomizer or cartomizer).

A further movement of the further portion with respect to the tray may detach the further portion from the replaceable portion (e.g. liquid reservoirs, atomizers and/or cartomizers). The further movement may be a continuous prolongation of the movement. A force required for releasably clamping the replaceable portion (e.g. liquid reservoir, atomizer or cartomizer) in the cavity may not exceed a further force required for releasing the atomizer from the further portion.

Alternatively, the further movement may be orthogonal to the movement.

A counter-movement of the further portion, with respect to the tray, attached to the releasably clamped replaceable portion (e.g. liquid reservoir, atomizer or cartomizer) may release the clamped atomizer from being clamped; the counter-movement may be directed opposite to the movement. A further counter-movement may attach the further portion to the clamped replaceable portion (e.g. liquid reservoir, atomizer or cartomizer); and the further counter-movement may be directed opposite to the further movement. The counter-movement may be a continuous prolongation of the further counter-movement. A counter-force required for releasing the replaceable portion (e.g. liquid reservoir, atomizer or cartomizer) from the tray may equal or exceed a further counter-force required for attaching the replaceable portion (e.g. liquid reservoir, atomizer or cartomizer) to the further portion. Alternatively, the further counter-movement is orthogonal to the counter-movement.

The counter-movement may be a rotation. Each of the cavities may comprise a bayonet joint. Each of the cavities may comprise an inner surface at least partly configured for interacting with a dented surface or a dented surface part of the replaceable portion (e.g. liquid reservoir, atomizer or cartomizer) for achieving the clamping. The cavities may be arranged along a furrow extending in a first direction and pressure on the tray in a second direction perpendicular to the first direction may increase a width of the cavities such that the replaceable portion (e.g. liquid reservoir, atomizer or cartomizer) can be received and removal of the pressure reduces the width such that the received atomizer becomes releasably clamped. For each cavity there may be a different part of a surface of the tray onto which the pressure has to be applied for increasing the width.

Different types of atomizers/cartomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination with or in the absence of a heater.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 electronic smoking device
12 battery portion
14 atomizer/liquid reservoir portion
16 end cap
18 battery
20 light-emitting diode (LED)
22 control electronics
24 airflow sensor
26, 26' atomizer
28 heating coil
30 wick
32 central passage
34 liquid reservoir
36 air inhalation port
38 air inlets
40 dented surface
50 tray
52 cavity
54 furrow
56, 58 opposing surfaces
60 further furrow
R first movement, second movement
R' first counter-movement, second counter-movement
X first direction
Y second direction

The invention claimed is:

1. A tray (50) for replaceable portions (26, 26'), the replaceable portions (26, 26') being configured for releasable attachment to an electronic smoking device (10), the tray (50) comprising a plurality of cavities (52) each configured for receiving one of the replaceable portion (26, 26'), wherein each replaceable portion (26, 26') can be releasably clamped therein by a first movement (R) with respect to the tray (50);

wherein the cavities (52) are arranged along a furrow (54) extending in a first direction (X), wherein a pressure on the tray (50) in a second direction perpendicular to the first direction (X) increases a width of the cavities (52) such that the replaceable portion (26, 26') can be received, and wherein a pressure reduction decreases the width of the cavities (52) such that the received replaceable portion (26, 26') is releasably clamped.

2. The tray (50) according to claim 1, wherein the tray (50) is further configured such that a second movement (R) of the electronic smoking device (10) with respect to the tray (50) detaches the electronic smoking device (10) from the replaceable portion (26, 26').

3. The tray (50) according to claim 2, wherein the second movement (R) is a continuous prolongation of the first movement (R).

4. The tray (50) according to claim 3, wherein a first force required for releasably clamping the replaceable portion (26, 26') in the cavity (52) is equal to or smaller than a second force required for releasing the replaceable portion (26, 26') from the electronic smoking device (10).

5. The tray (50) according to claim 2, wherein the second movement is orthogonal to the first movement (R).

6. The tray (50) according to claim 1, wherein a first counter-movement (R) of the electronic smoking device (10) attached to the clamped replaceable portion (26, 26') with respect to the tray (50) releases the clamped replaceable portion (26, 26') from being clamped, wherein the first counter-movement (R') is directed opposite to the first movement (R).

7. The tray (50) according to claim 6, wherein a second counter-movement (R') attaches the electronic smoking device (10) to the clamped replaceable portion (26, 26'), wherein the second counter-movement (R') is directed opposite to the second movement (R).

8. The tray (50) according to claim 7, wherein the first counter-movement (R') is a continuous prolongation of the second counter-movement (R').

9. The tray (50) according to claim 8, wherein a first counter-force required for releasing the replaceable portion (26, 26') from the tray (50) is equal to or greater than a second counter-force required for attaching the replaceable portion (26, 26') to the electronic smoking device (10)).

10. The tray (50) according to claim 6, wherein a second counter-movement is orthogonal to the first counter-movement (R').

11. The tray (50) according to claim 6, wherein the first counter-movement (R') is a rotation.

12. The tray (50) according to claim 1, wherein each of the cavities (52) comprises a bayonet joint.

13. The tray (50) according to claim 1, wherein each of the cavities (52) comprises an inner surface at least partly configured for interacting with a dented surface (40) or a dented surface part of the replaceable portion (26, 26') for achieving the releasably clamping.

14. The tray (50) according to claim 1, wherein the tray (50) comprises a plurality of pressure receiving portions, each of the portions being operatively connected with a corresponding cavity (52), wherein the pressure receiving portions are separated from one another.

15. A tray for replaceable portions configured for releasable attachment to an electronic smoking device, the tray comprising:

a plurality of cavities in a line extending in a first direction, wherein an opening force on the tray in a second direction perpendicular to the first direction increases a width of at least one of the cavities such that a replaceable portion can be received in the at least one cavity, and wherein release of the opening force decreases the width of the at least one cavity and clamps the replaceable portion.

16. The tray of claim 15 wherein the replaceable portion is attached to the electronic smoking device with a holding force and wherein the tray clamps the replaceable portion with a force greater than the holding force.

17. The tray of claim 16 further including a bayonet fitting in each of the cavities.

18. The tray of claim 16 wherein each of the cavities comprises an inner surface at least partly configured for interacting with a dented surface of the replaceable portion.

19. The tray of claim 16 wherein each of the cavities has a rotational element which releasably clamps the replaceable portion with rotational movement of the replaceable portion.

* * * * *